US005810889A

United States Patent [19]

Kaufmann et al.

[11] Patent Number: 5,810,889

[45] Date of Patent: Sep. 22, 1998

[54] AQUEOUS TEXTILE TREATMENT COMPOSITIONS CONTAINING AN ULTRA-VIOLET ABSORBING AGENT

[75] Inventors: Werner Kaufmann, Rheinfelden; Rolf Hilfiker, Basel; Hanspeter Gysin, Aesch; Urs Hofer, Basel; Robert Truniger, Pratteln; Hans Peter Härri, Reinach, all of Switzerland

[73] Assignee: Ciba Specialty Chemicals Corporation, Tarrytown, N.Y.

[21] Appl. No.: 768,051

[22] Filed: Dec. 16, 1996

Related U.S. Application Data

[63] Continuation of Ser. No. 469,591, Jun. 6, 1995, abandoned.

[30] Foreign Application Priority Data

| | | | |
|---|---|---|---|
| Jul. 23, 1994 | [GB] | United Kingdom | 9414882 |
| Sep. 17, 1994 | [GB] | United Kingdom | 9418802 |
| Sep. 17, 1994 | [GB] | United Kingdom | 9418842 |

[51] Int. Cl.[6] ..... D06M 13/352; D06M 13/358

[52] U.S. Cl. ..... 8/442; 8/648; 8/566; 8/573; 8/581; 8/582; 8/576; 8/588; 8/606; 252/301.23; 252/301.89

[58] Field of Search ..... 8/442, 490, 648, 8/566, 581, 552, 573, 576, 602, 588, 582; 252/8.57–8.91; 212/301.23, 301.29

[56] References Cited

U.S. PATENT DOCUMENTS

| | | | |
|---|---|---|---|
| 4,562,002 | 12/1985 | Neiditch et al. | 252/8.75 |
| 4,675,352 | 6/1987 | Winter et al. | 524/91 |
| 4,698,064 | 10/1987 | Evans et al. | 8/128 R |
| 4,760,148 | 7/1988 | Seltzer et al. | 548/260 |
| 4,770,667 | 9/1988 | Evans et al. | 8/128.1 |
| 4,772,404 | 9/1988 | Fox et al. | 252/8.8 |
| 4,940,469 | 7/1990 | Möckel et al. | 8/527 |
| 4,964,871 | 10/1990 | Reinert et al. | 8/115.59 |
| 4,990,623 | 2/1991 | Berenbaum et al. | 548/260 |
| 5,021,478 | 6/1991 | Ravichandran et al. | 524/91 |
| 5,037,979 | 8/1991 | Höhener et al. | 544/216 |
| 5,039,642 | 8/1991 | Chrobaczek et al. | 502/155 |
| 5,051,111 | 9/1991 | Anceschi et al. | 8/648 |
| 5,197,991 | 3/1993 | Rembold | 8/490 |
| 5,292,503 | 3/1994 | Raleigh et al. | 424/59 |
| 5,374,362 | 12/1994 | McFarland | 252/816 |

FOREIGN PATENT DOCUMENTS

| | | |
|---|---|---|
| B81262/91 | 1/1992 | Australia . |
| 0112120 | 6/1984 | European Pat. Off. . |
| 0132138 | 1/1985 | European Pat. Off. . |
| 0275694 | 7/1988 | European Pat. Off. . |
| 357545 | 3/1990 | European Pat. Off. . |
| 0474595 | 3/1992 | European Pat. Off. . |
| 2229742 | 10/1990 | United Kingdom . |
| WO94/04515 | 3/1994 | WIPO . |

OTHER PUBLICATIONS

Hawley's Condensed Chemical Dictionary, 1987 pp. 1039–1040.

*Primary Examiner*—Margaret Einsmann
*Attorney, Agent, or Firm*—Kevin T. Mansfield; David R. Crichton

[57] ABSTRACT

The present invention provides an aqueous textile treatment composition comprising:

a) a non-reactive UVA compound;

b) an emulsifier for the UVA compound;

c) water, and, optionally, d) a polysiloxane-based product;

as well as a method of treating a textile fibre material with this composition. The treated textile fibre material, in addition to having an excellent sun protection factor (SPF) value, may also exhibit improved wash permanence and other desirable properties.

18 Claims, No Drawings

AQUEOUS TEXTILE TREATMENT COMPOSITIONS CONTAINING AN ULTRA-VIOLET ABSORBING AGENT

This application is a continuation of application Ser. No. 08/469,591, filed Jun. 6, 1995, now abandoned.

The present invention relates to aqueous compositions and, in particular, to aqueous compositions which contain an ultra-violet absorbing agent (UVA) and which may impart to textile fibre material treated with the aqueous compositions, in addition to an excellent sun protection factor (SPF) value, improved wash permanence and other desirable properties.

It is known that light radiation of wavelengths 280–400 nm permits tanning of the epidermis. Also known is that rays of wavelengths 280–320 nm (termed UV-B radiation), cause erythemas and skin burning which can inhibit skin tanning.

Radiation of wavelengths 320–400 nm (termed UV-A radiation) is known to induce skin tanning but can also cause skin damage, especially to sensitive skin which is exposed to sunlight for long periods. Examples of such damage include loss of skin elasticity and the appearance of wrinkles, promotion of the onset of erythemal reaction and the inducement of phototoxic or photoallergic reactions.

Any effective protection of the skin from the damaging effects of undue exposure to sunlight clearly needs to include means for absorbing both UV-A and UV-B components of sunlight before they reach the skin surface.

Traditionally, protection of exposed human skin against potential damage by the UV components in sunlight has been effected by directly applying to the skin a preparation containing a UVA. In areas of the world, e.g. Australia and America, which enjoy especially sunny climates, there has been a great increase in the awareness of the potential hazards of undue exposure to sunlight, compounded by fears of the consequences of alleged damage to the ozone layer. Some of the more distressing embodiments of skin damage caused by excessive, unprotected exposure to sunlight are development of melanomas or carcinomas on the skin.

One aspect of the desire to increase the level of skin protection against sunlight has been the consideration of additional measures, over and above the direct protection of the skin. For example, consideration has been given to the provision of protection to skin covered by clothing and thus not directly exposed to sunlight.

Most natural and synthetic textile materials are at least partially permeable to UV components of sunlight. Accordingly, the mere wearing of clothing does not necessarily provide skin beneath the clothing with adequate protection against damage by UV radiation. Although clothing containing a deeply coloured dye and/or having a tight weave texture may provide a reasonable level of protection to skin beneath it, such clothing is not practical in hot sunny climates, from the standpoint of the personal comfort of the wearer.

There is a need, therefore, to provide protection against UV radiation for skin which lies underneath clothing, including lightweight summer clothing, which is undyed or dyed only in pale shades. Depending on the nature of the dyestuff, even skin beneath clothing dyed in some dark shades may also require protection from UV radiation.

Such lightweight summer clothing normally has a density of of less than 200 g/m$^2$ and has a sun protection factor rating between 1.5 and 20, depending on the type of fibre from which the clothing is manufactured.

The SPF rating of a sun protectant (sun cream or clothing) may be defined as the multiple of the time taken for the average person wearing the sun protectant to suffer sun burning under average exposure to sun. For example, if an average person would normally suffer sun burn after 30 minutes under standard exposure conditions, a sun protectant having an SPF rating of 5 would extend the period of protection from 30 minutes to 2 hours and 30 minutes. For people living in especially sunny climates, where mean sun burn times are minimal, e.g. only 15 minutes for an average fair-skinned person at the hottest time of the day, SPF ratings of at least 20 are desired for lightweight clothing.

It is already known, e.g. from WO 94/4515, that the application of a UVA to a light-weight textile material in general can effect an increase in the SPF value of the textile so treated. The increase in SPF value achieved thereby, however, is relatively modest.

The selection of a suitable UVA, for use in a method for effecting an increase in the SPF value of a textile fibre material (often referred to as a "UV cutting" treatment method), has to take into account the fact that the treated textile fibre material must satisfy performance criteria in a wide range of areas, such as washfastness, lightfastness and tear resistance, apart from its SPF value.

Surprisingly, it has now been found that the aqueous application of certain non-reactive UVAs to a textile fibre material, may impart to the material, in addition to an excellent SPF value, a wash permanence which is entirely acceptable for commercial purposes, as well as other desirable properties.

Accordingly, the present invention provides, as a first aspect, an aqueous textile treatment composition comprising:

a) a non-reactive UVA compound;

b) an emulsifying or dispersing agent for the UVA compound;

c) water, and, optionally, d) a polysiloxane-based product.

The UVA used may be any of the wide range of known UVA compounds, that is organic compounds which readily absorb UV light, especially in the range $\lambda$=200 to 400 nm, and which convert the absorbed energy, by a chemical intermediate reaction, into non-interfering, stable compounds or into non-interfering forms of energy. Preferred are those UVA compounds which absorb strongly at a wavelength of 305 nm, which is the wavelength at which most erythemal skin damage is caused.

Preferably, the UVA compound used is one which is capable of being firmly absorbed on to the textile fibre material during a conventional textile fibre material treatment process.

The amount of the UVA compound in the composition containing at least one UVA compound which absorbs radiation in the wavelength range 280–400 nm, used in the method of the present invention, preferably ranges from 0.01 to 3%, especially from 0.01 to 1% by weight, based on the weight of the textile fibre material and the absorbance of the UVA compound.

The UVA compound used may be, e.g., an oxalic anilide, a hydroxybenzophenone, a hydroxyaryl-1,3,5-triazine, a sulphonated-1,3,5-triazine, an o-hydroxyphenylbenzotriazole, a 2-aryl-2H-benzotriazole, a salicylic acid ester, a substituted acrylonitrile, a substituted arylaminoethylene or a nitrilohydrazone.

Such known UVA compounds for use in the present invention are described, for example, in the U.S. patent specifications Nos. 2,777,828, 2,853,521, 3,118,887, 3,259,627, 3,293,247, 3,382,183, 3,403,183, 3,423,360, 4,127,586, 4,141,903, 4,230,867, 4,675,352 and 4,698,064.

Preferred UVA compounds for use in the present invention include those of the triazine or triazole class.

One preferred class of triazine UVA compounds is that having the formula:

(1)

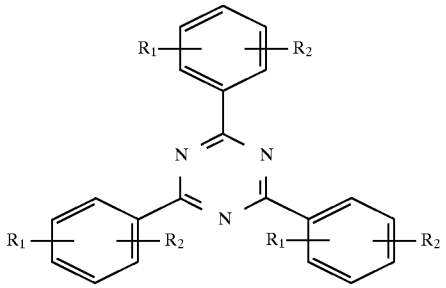

in which $R_1$ and $R_2$, independently, are hydrogen, hydroxy or $C_1$–$C_5$alkoxy.

A second preferred class of triazine UVA compounds is that having the formula:

(2)

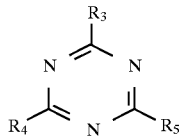

in which at least one of $R_3$, $R_4$ and $R_5$ is a radical of formula:

(3)

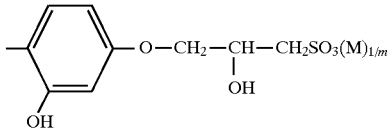

in which M is hydrogen, sodium, potassium, calcium, magnesium, ammonium, mono-, di-, tri- or tetra-$C_1$–$C_4$alkylammonium, mono-, di- or tri-$C_1$–$C_4$hydroxyalkylammonium or ammonium that is di- or tri-substituted by a mixture of $C_1$–$C_4$alkyl and $C_1$–$C_4$hydroxyalkyl groups; m is 1 or 2; and the remaining substituent(s) $R_3$, $R_4$ and $R_5$ are, independently, amino, $C_1$–$C_{12}$alkyl, $C_1$–$C_{12}$alkoxy, $C_1$–$C_{12}$alkylthio, mono- or di-$C_1$–$C_{12}$alkylamino, phenyl, phenylthio, anilino or N-phenyl-N-$C_1$–$C_4$alkylamino, preferably N-phenyl-N-methylamino or N-phenyl-N-ethylamino, the respective phenyl substituents being optionally substituted by $C_1$–$C_{12}$alkyl or -alkoxy, $C_5$–$C_8$cycloalkyl or halogen.

A third preferred class of triazine UVA compounds is that having the formula:

(4)

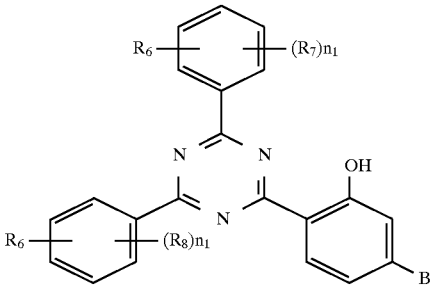

in which $R_6$ is hydrogen or hydroxy; $R_7$ and $R_8$, independently, are hydrogen or $C_1$–$C_4$alkyl; $n_1$ is 1 or 2; and B is a group of formula:

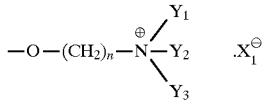

in which n is an integer ranging from 2 to 6, preferably 2 or 3; $Y_1$ and $Y_2$, independently, are $C_1$–$C_4$alkyl optionally substituted by halogen, cyano, hydroxy or $C_1$–$C_4$alkoxy or $Y_1$ and $Y_2$, together with the nitrogen atom to which they are each attached, form a 5–7 membered heterocyclic ring, preferably a morpholine, pyrrolidine, piperidine or hexamethyleneimine ring; $Y_3$ is hydrogen, $C_3$–$C_4$alkenyl or $C_1$–$C_4$alkyl optionally substituted by cyano, hydroxy or $C_1$–$C_4$alkoxy or $Y_1$, $Y_2$ and $Y_3$, together with the nitrogen atom to which they are each attached, form a pyridine or picoline ring; and $X_1^{\ominus}$ is a colourless anion, preferably $CH_3OSO_3^{\ominus}$ or $C_2H_5OSO_3^{\ominus}$.

One especially preferred class of triazole UVA compounds is that having the formula:

(5)

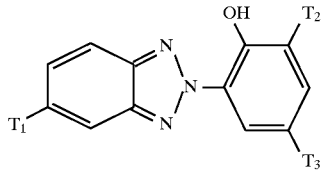

in which $T_1$ is chlorine or, preferably, hydrogen; $T_2$ is hydrogen or a $C_4$–$C_{30}$—, preferably a $C_4$–$C_{16}$—, more preferably a $C_9$–$C_{12}$—, especially a $C_{12}$alkyl group; and $T_3$ is a $C_1$–$C_5$alkyl group, optionally substituted by a phenyl group or optionally substituted by a group —CO—O—$C_1$–$C_{18}$alkyl which is optionally substituted by a hydroxy group and is optionally interrupted by one or two oxygen atoms.

In the compounds of formula (5), $T_2$ may be a discrete $C_4$–$C_{30}$alkyl group such as a tertiary butyl group, or a random statistical mixture of at least three isomeric branched sec. $C_8$–$C_{30}$, preferably $C_8$–$C_{16}$, especially $C_9$–$C_{12}$alkyl groups, each having the formula —$CH(E_1)(E_2)$ in which $E_1$ is a straight chain $C_1$–$C_4$alkyl group and $E_2$ is a straight chain $C_4$–$C_{15}$alkyl group, the total number of carbon atoms in $E_1$ and $E_2$ being from 7 to 29.

A second preferred class of triazole UVA compounds is that having the formula:

(6)

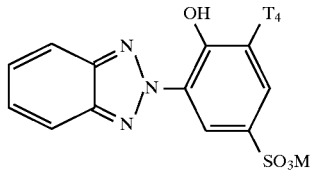

in which M has its previous significance, but is preferably sodium, and $T_4$ is hydrogen, $C_1$–$C_{12}$alkyl or benzyl.

A third preferred class of triazole UVA compounds is that having the formula:

(7)

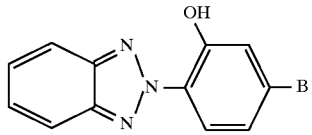

in which B has its previous significance.

In the compounds of formulae (1) to (7), $C_1$–$C_{12}$Alkyl groups $R_3$, $R_4$, $R_5$, $T_3$ and $T_4$ may be methyl, ethyl, n-propyl, isopropyl, n-butyl, isobutyl, tert-butyl,n-amyl, n-hexyl, n-heptyl, n-octyl, isooctyl, n-nonyl, n-decyl, n-undecyl and n-dodecyl, methyl and ethyl being preferred, except in the cases of $T_3$ for which methyl is preferred and $T_4$ for which isobutyl is preferred $C_8$–$C_{30}$alkyl groups $T_2$ include sec.octyl, decyl, dodecyl, tridecyl, tetradecyl, hexadecyl, octadecyl, eicosyl and triacontyl groups.

$C_1$–$C_5$Alkoxy groups $R_1$ or $R_2$ may be, e.g., methoxy, ethoxy, n-propoxy, isopropoxy, n-butoxy, isobutoxy, tert.-butoxy or n-amyloxy, preferably methoxy or ethoxy, especially methoxy. $C_1$–$C_{12}$Alkoxy groups $R_3$, $R_4$ and $R_5$ include those indicated for the $C_1$–$C_5$alkoxy groups $R_1$ or $R_2$ together with, e.g., n-hexoxy, n-heptoxy, n-octoxy, isooctoxy, n-nonoxy, n-decoxy, n-undecoxy and n-dodecoxy, methoxy and ethoxy being preferred.

$C_1$–$C_{12}$Alkylthio groups $R_3$, $R_4$ and $R_5$ may be, e.g., methylthio, ethylthio, n-propylthio, isopropylthio, n-butylthio, isobutylthio, tert.-butylthio, n-amylthio, hexylthio, n-heptylthio, n-octylthio, isooctylthio, n-nonylthio, n-decylthio, n-undecylthio and n-dodecylthio, methylthio and ethylthio being preferred.

$C_1$–$C_{12}$Mono- or di-alkylamino groups $R_3$, $R_4$ and $R_5$ include, e.g., mono- or di-methylamino, ethylamino, n-propylamino, isopropylamino, n-butylamino, isobutylamino, tert.-butylamino, n-amylamino, n-hexylamino, n-heptylamino, n-octylamino, isooctylamino, n-nonylamino, n-decylamino, n-undecylamino and n-dodecylamino, mono- or di-methylamino or ethylamino being preferred The alkyl radicals in the mono-, di-, tri- or tetra-$C_1$–$C_4$alkylammonium groups M are preferably methyl. Mono-, di- or tri-$C_1$–$C_4$hydroxyalkylammonium groups M are preferably those derived from ethanolamine, di-ethanolamine or tri-ethanolamine. When M is ammonium that is di- or tri-substituted by a mixture of $C_1$–$C_4$alkyl and $C_1$–$C_4$hydroxyalkyl groups, it is preferably N-methyl-N-ethanolamine or N,N-dimethyl-N-ethanolamine. M is preferably, however, hydrogen or sodium.

Preferred compounds of formula (1) are those having the formulae:

(8)

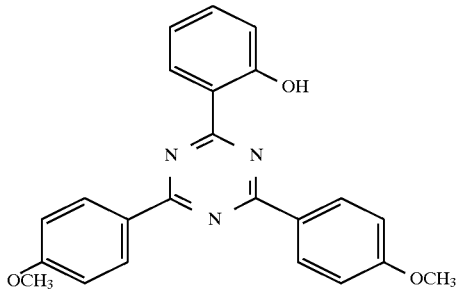

(9)

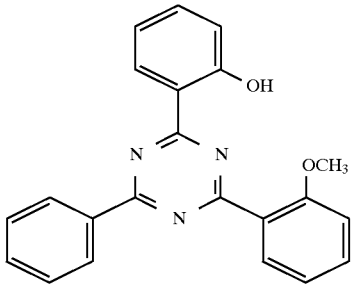

-continued (10)

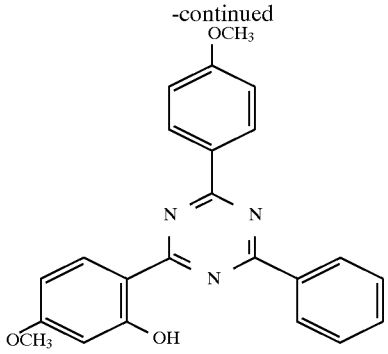

(11)

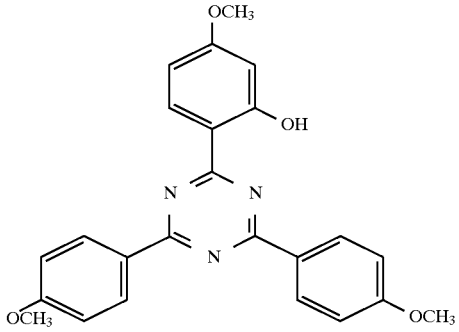

(12)

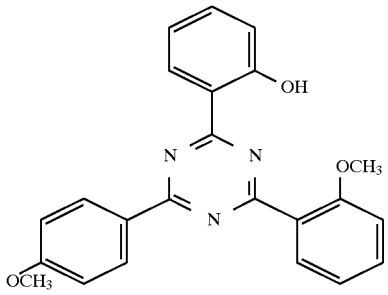

(13)

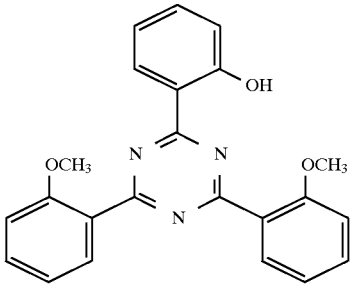

(14)

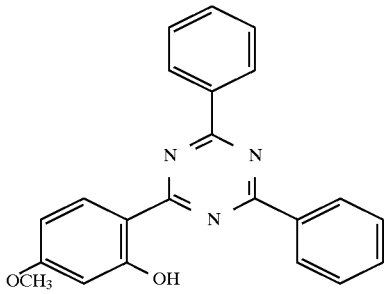

The compounds of formula (1) are known and may be prepared e.g. by the method described in U.S. Pat. No. 3,118,887.

Preferred compounds of formula (2) are those having the formula:

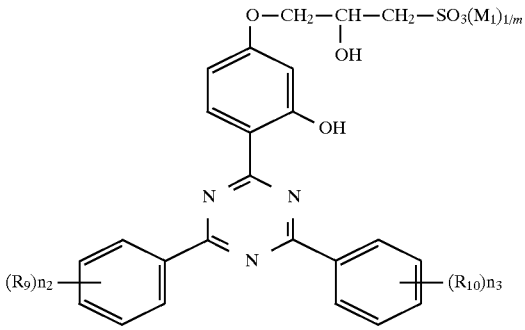

(15)

in which $R_9$ and $R_{10}$, independently, are $C_1$–$C_{12}$alkyl, preferably methyl; m is 1 or 2; $M_1$ is hydrogen, sodium, potassium, calcium, magnesium, ammonium or tetra-$C_1$–$C_{12}$alkylammonium, preferably hydrogen; and $n_2$ and $n_3$, independently, are 0, 1 or 2, preferably 1 or 2.

Particularly preferred compounds of formula (15) are:

2,4-diphenyl-6-[2-hydroxy-4-(2-hydroxy-3-sulfopropoxy)-phenyl]-1,3,5-triazine;

2-phenyl-4,6-bis-[2-hydroxy-4-(2-hydroxy-3-sulfopropoxy)-phenyl]-1,3,5-triazine;

2,4-bis(2,4-dimethylphenyl)-6-[2-hydroxy-4-(2-hydroxy-3-sulfopropoxy)-phenyl]-1,3,5-triazine; and 2,4-bis(4-methylphenyl)-6-[2-hydroxy-4-(2-hydroxy-3-sulfo propoxy)-phenyl]- 1,3,5-triazine.

The compounds of formula (2) are known and may be prepared in the manner, e.g., described in U.S. Pat. No. 5,197,991.

The compounds of formula (5) are known and may be prepared in the manner, e.g., described in U.S. Pat. No. 4,675,352 or U.S. Pat. No. 4,853,471.

The compounds of formula (6) are known and may be prepared in the manner, e.g., described in EP-A-0 314 620.

The compounds of formula (7) are known and may be prepared in the manner, e.g., described in EP-A-0 357 545.

The polysiloxane-based product, component d), may be any such commercially available product, such as an elastomer, hydrophobising agent, film- or non film-forming product or fabric softener which is conventionally used for the finishing of a textile fibre material. Examples of such polysiloxane-based products include alkylpolysiloxanes, e.g. polydimethylsiloxanes, optionally containing epoxy, hydroxy and/or polyethoxy or polypropoxy or polyethoxy/polypropoxy groups. Particularly preferred examples include Polysiloxane Q 2-7005, which is sold by Dow Corning, and Polymer 5000 (Wacker Chemie).

The polysiloxane-based product is usually formulated as an aqueous emulsion using, as emulsifying agent, one or more anionic, nonionic or cationic emulsifiers. The pH of the emulsion is conventionally adjusted to a value of 5–6 using, e.g., hydrochloric acid. Particularly effective aqueous emulsions of a polysiloxane-based product, for use in the aqueous textile finishing composition of the present invention, include polydimethylsiloxane emulsions, such as the product Dicrylan WK (available from Pfersee).

The textile treatment composition of the present invention preferably also contains one or more auxiliaries which are conventionally present in textile treatment compositions. Preferred auxiliaries include fluorescent whitening agents, crease-resist agents, fabric softeners, stiffening agents and anti-static agents. Suitable fluorescent whitening agents include 4,4'-bis-(triazinylamino)-stilbene-2,2'-disulfonic acids, 4,4'-bis-(triazol-2-yl)stilbene-2,2'-disulfonic acids, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarines, pyrazolines, naphthalimides, triazinyl-pyrenes, 2-styryl-benzoxazole- or naphthoxazole derivatives or benzimidazole-benzofuran derivatives.

It is preferred that components a) and b) are each present in a proportion within the range of from 0.1 to 10%, more preferably from 0.5 to 5%, especially from 2 to 4% by weight, based on the total weight of the composition.

When present, component d) is preferably used in an amount ranging from 0.5 to 20%, especially from 1 to 10% by weight, based on the total weight of the composition.

Any auxiliary is preferably present in a proportion within the range of from 0.05 to 5%, especially from 0.1 to 2% by weight, based on the total weight of the composition.

The present invention also provides, as a second aspect, a method of treating a textile fabric material comprising contacting the material with an aqueous textile treatment composition comprising:

a) a UVA compound;

b) an emulsifying or dispersing agent for the UVA compound;

c) water, and, optionally, d) a polysiloxane-based product.

As a third aspect, the present invention provides a method of improving the SPF of a textile fibre material comprising contacting the material with an aqueous textile treatment composition comprising:

a) a UVA compound;

b) an emulsifying or dispersing agent for the UVA compound;

c) water; and, optionally, d) a polysiloxane-based product.

The methods of the present invention may be conducted using any of the conventional textile treatment techniques, such as the exhaust, padding, coating, spraying or dipping methods.

It is usually beneficial to carry out the methods of treatment according to the invention in an acidic bath. If a padding method is used, it is normally conducted at ambient temperature, for example at a temperature in the range of from 15° to 30° C.

Solutions of the UVA compound, or their emulsions in organic solvents may also be used in the methods of the present invention. For example, the so-called solvent dyeing (pad thermofix application) or exhaust dyeing methods in dyeing machines may be used.

It is also known that for untreated textile materials, e.g. cotton, for a given constant thickness of material, the SPF rating hardly varies at all as a function of the number of pores in the material, and remains at an almost constant low level. As a consequence, even cotton which has been tightly woven, but using a fine yarn, will exhibit an inadequate SPF value of only about 3. Thus, a mere increase in the tightness of the weave of a fabric (or a reduction in the number of pores therein), per se, cannot substantially increase the SPF rating of a fabric.

Surprisingly, it has now been found that, in order to optimise the SPF rating of a textile fibre material, it is necessary to strictly control the proportion of pores in the textile fibre material per unit volume, before it is treated with a UVA and/or a fluorescent whitening agent (FWA) compound. The treatment, using a UVA and/or an FWA compound, of a textile fibre material for which the proportion of pores is from 0–10% by volume, increases the SPF rating of the material so treated to a dramatic and unexpected degree. The said textiles, when so treated, can attain an SPF value far in excess of 40.

Accordingly, the present invention still further provides, as a fourth aspect, a method of improving the sun protection factor (SPF) of a textile fibre material comprising treating the textile fibre material with a composition containing at least one ultraviolet absorbing agent (UVA) or a fluorescent whitening agent (FWA) each of which absorbs radiation in the wavelength range 280–400 nm, or a mixture thereof, characterised in that the proportion of pores in the textile fibre material is from 0–10%, preferably from 0–5% per unit area.

The textile fibre material treated according to the method of the present invention may be of natural or synthetic origin but is preferably made of cellulosic fibres such as cotton or linen, silk, wool, polyester, polyamide, viscose, polyacrylonitrile, polyacrylate or mixtures thereof, especially cellulosic fibres, in particular cotton, and is preferably in the form of thin woven material having a thickness of 0.01 to 4 mm., especially 0.1 to 1 mm.

The textile fibre material may be in the form of endless filaments (stretched or unstretched), staple fibres, flocks, hanks, textile filament yarns, threads, nonwovens, felts, waddings, flocked structures or woven textiles or bonded textile fabrics or knitted fabrics.

As already indicated, the textile fibre material must have a proportion of pores of from 0–10%, preferably from 0–5% per unit area. The determination of the proportion of pores in a textile fibre material may be effected by any convenient method such by direct transmission of light or by using microscopic techniques.

The UVA and/or FWA used according to this aspect of the present invention is as indicated hereinbefore in relation to earlier aspects of the present invention.

Preferred 4,4'-bis-(triazinylamino)-stilbene-2,2'-disulfonic acid FWAs are those having the formula:

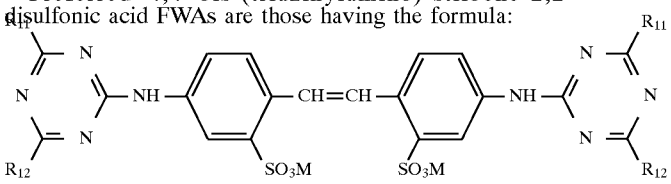

(16)

in which $R_{11}$, and $R_{12}$, independently, are phenylamino, mono- or disulfonated phenylamino, morpholino, —$N(CH_2CH_2OH)_2$, —$N(CH_3)(CH_2CH_2OH)$, —$NH_2$, —$N(C_1C_4\text{-alkyl})_2$, —$OCH_3$, —Cl, —NH—$CH_2CH_2SO_3H$ or —NH—$CH_2CH_2OH$; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted with by a mixture of $C_1$–$C_4$-alkyl and $C_1$–$C_4$-hydroxyalkyl groups.

Especially preferred compounds of formula (16) are those in which each $R_{11}$ is 2,5-disulfophenylamino and each $R_{12}$ is morpholino; or each $R_{11}$ is 2,5-disulfophenylamino and each $R_{12}$ is $N(C_2H_5)_2$; or each $R_{11}$ is 3-sulfophenyl and each $R_{12}$ is $NH(CH_2CH_2OH)$ or $N(CH_2CH_2OH)_2$; or each $R_{11}$ is 4-sulfophenyl and each $R_{12}$ is $N(CH_2CH_2OH)_2$; and, in each case, the sulfo group is $SO_3M$ in which M is sodium.

Preferred 4,4'-bis-(triazol-2-yl)stilbene-2,2'-disulfonic acids are those having the formula:

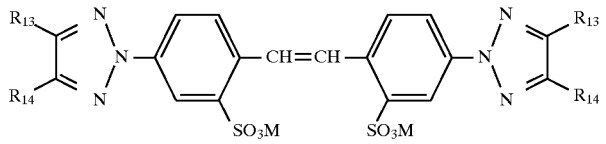

(17)

in which $R_{13}$ and $R_{14}$, independently, are H, $C_1$–$C_4$-alkyl, phenyl or monosulfonated phenyl; and M has its previous significance.

Especially preferred compounds of formula (17) are those in which $R_{13}$ is phenyl $R_{14}$ is H and M is sodium.

One preferred 4,4'-(diphenyl)-stilbene is that having the formula:

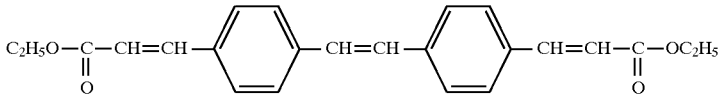

(18)

Preferably, 4,4'-distyryl-biphenyls used are those of formula:

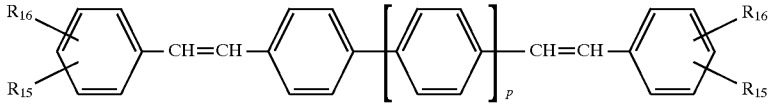

(19)

in which $R_{15}$ and $R_{16}$, independently, are H, $SO_3M$, $SO_2N(C_1\text{–}C_4\text{-alkyl})_2$, O—($C_1$–$C_4$-alkyl), CN, Cl, $COO(C_1\text{–}C_4\text{-alkyl})$, $CON(C_1\text{–}C_4\text{-alkyl})_2$ or $O(CH_2)_3N^{\oplus}(CH_3)_2An^{\ominus}$ in which $An^{\ominus}$ is an anion of an organic or inorganic acid, in particular a formate, acetate, propionate, glcolate, lactate, acrylate, methanephosphonate, phosphite, dimethyl or diethyl phosphite anion, or a mixture thereof; and p is 0 or 1.

Especially preferred compounds of formula (19) are those in which n is 1 and each $R_{15}$ is a 2-$SO_3M$ group in which M is sodium and each $R_{16}$ is H, or each $R_{15}$ is $O(CH_2)_3N\oplus(CH_3)_2An^{\ominus}$ in which $An^{\ominus}$ is acetate.

Preferred 4-phenyl-4'-benzoxazolyl-stilbenes have the formula:

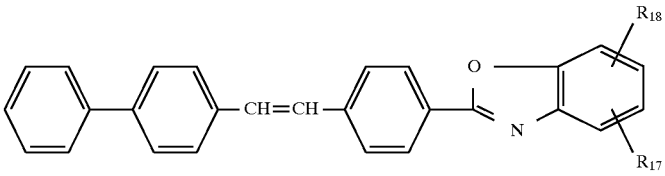

(20)

in which $R_{17}$ and $R_{18}$, independently, are H, Cl, $C_1$–$C_4$-alkyl or —$SO_2$—$C_1$–$C_4$-alkyl.

An especially preferred compound of formula (20) is that in which $R_{17}$ is 4-$CH_3$ and $R_{18}$ is 2-$CH_3$.

Preferably, stilbenyl-naphthotriazoles used are those of formula:

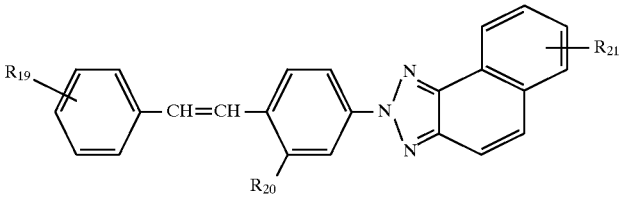

(21)

in which $R_{19}$ is H or Cl; $R_{20}$ is $SO_3M$, $SO_2N(C_1$–$C_4$-alkyl$)_2$, $SO_2O$-phenyl or CN; $R_{21}$ is H or $SO_3M$; and M has its previous significance.

Especially preferred compounds of formula (21) are those in which $R_{19}$ and $R_{21}$ are H and $R_{20}$ is 2-$SO_3M$ in which M is Na.

Preferably, 4-stryl-stilbenes used are those of formula:

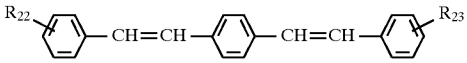

(22)

in which $R_{22}$ and $R_{23}$, independently, are CN, COO($C_1$–$C_4$-alkyl) or CON($C_1$–$C_4$-alkyl$)_2$.

Especially preferred compounds of formula (22) are those in which each of $R_{22}$ and $R_{23}$ is 2-cyano.

Preferred bis-(benzoxazol-2-yl) derivatives are those of formula:

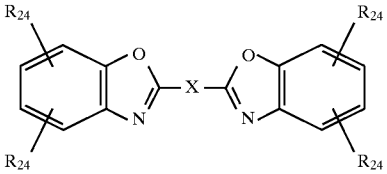

(23)

in which $R_{24}$, independently, is H, $C(CH_3)_3$, $C(CH_3)_2$-phenyl, $C_1$–$C_4$-alkyl or COO—$C_1$–$C_4$-alkyl, and X is —CH═CH— or a group of formula:

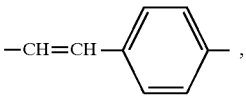

-continued

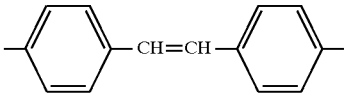

-continued

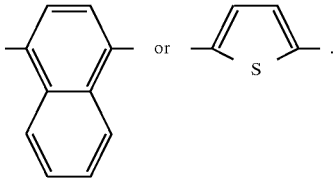

Especially preferred compounds of formula (23) are those in which each $R_{24}$ is H and X is

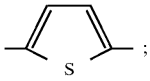

or one group $R_{24}$ in each ring is 2-methyl and the other $R_{24}$ is H and X is —CH═CH—; or one group $R_{24}$ in each ring is 2-$C(CH_3)_3$ and the other $R_{24}$ is H and X is

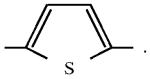

Preferred bis-(benzimidazol-2-yl) derivatives are those of formula:

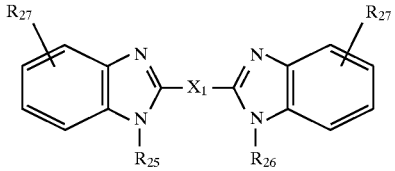

(24)

in which $R_{25}$ and $R_{26}$, independently, are H, $C_1$–$C_4$-alkyl or $CH_2CH_2OH$, $R_{27}$ is H or $SO_3M$; $X_1$ is —CH═CH— or a group of formula:

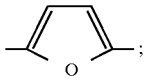

and M has its previous significance.

Especially preferred compounds of formula (24) are those in which $R_{25}$ and $R_{26}$ are each H, $R_{27}$ is $SO_3M$ in which M is sodium and $X_1$ is —CH═CH—.

Preferred coumarines are those of formula:

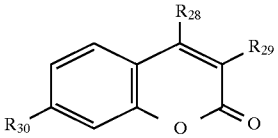

(25)

in which $R_{28}$ is H, Cl or $CH_2COOH$, $R_{29}$ is H, phenyl, COO—$C_1$–$C_4$-alkyl or a group of formula:

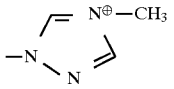

and $R_{30}$ is O—$C_1$–$C_4$-alkyl, N($C_1$–$C_4$-alkyl)$_2$, NH—CO—$C_1$–$C_4$-alkyl or a group of formula:

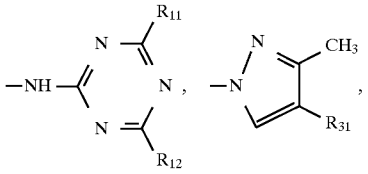

-continued

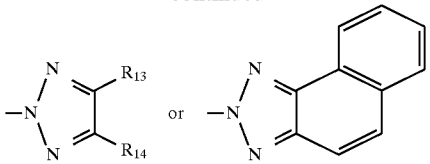

in which $R_{11}$, $R_{12}$, $R_{13}$ and $R_{14}$ have their previous significance and $R_{31}$ is H, $C_1$–$C_4$-alkyl or phenyl.

Especially preferred compounds of formula (25) are those having the formulae:

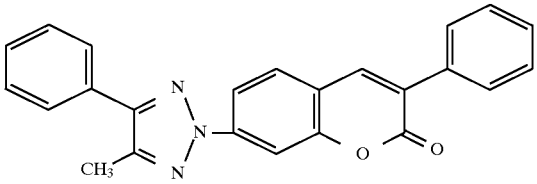

(26)

or

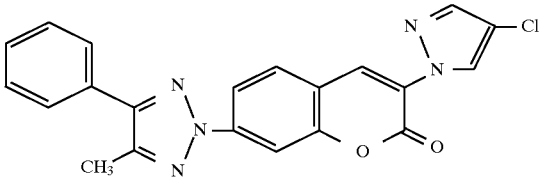

(27)

Preferably, pyrazolines used are those having the formula:

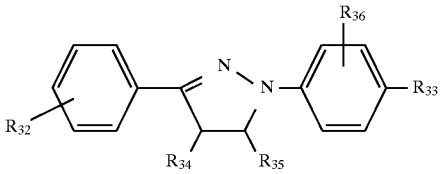

(28)

in which $R_{32}$ is H, Cl or N($C_1$–$C_4$-alkyl)$_2$, $R_{33}$ is H, Cl, $SO_3M$, $SO_2NH_2$, $SO_2NH$—($C_1$–$C_4$-alkyl), COO—$C_1$–$C_4$-alkyl, $SO_2$—$C_1$–$C_4$-alkyl, $SO_2NHCH_2CH_2CH_2N\oplus(CH_3)_3$ or $SO_2CH_2CH_2N\oplus H(C_1$–$C_4$-alkyl)$_2$ $An^{\ominus}$, $R_{34}$ and $R_{35}$ are the same or different and each is H, $C_1$–$C_4$-alkyl or phenyl and $R_{36}$ is H or Cl; and $An^{\ominus}$ and M have their previous significance.

Especially preferred compounds of formula (28) are those in which $R_{32}$ is Cl, $R_{33}$ is $SO_2CH_2CH_2N^{\oplus}H(C_1$–$C_4$-alkyl)$_2$ $An^{\ominus}$ in which $An^{\ominus}$ is phosphite and $R_{34}$, $R_{35}$ and $R_{36}$ are each H; or those those having the formulae:

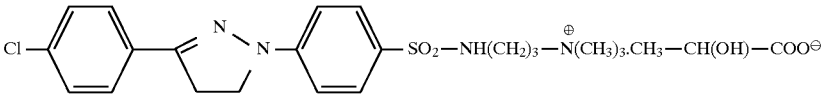

(29)

or

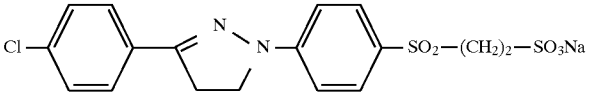

(30)

Preferred naphthalimides are those of formula:

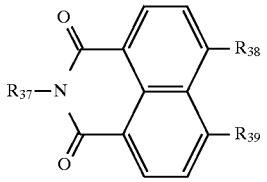

(31)

in which $R_{37}$ is $C_1$–$C_4$-alkyl or $CH_2CH_2CH_2N^{\oplus}(CH_3)_3$; $R_{38}$ and $R_{39}$, independently, are O—$C_1$–$C_4$-alkyl, $SO_3M$ or NH—CO—$C_1$–$C_4$-alkyl; and M has its previous significance.

Especially preferred compounds of formula (31) are those having the formulae:

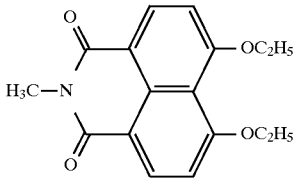

(32)

or

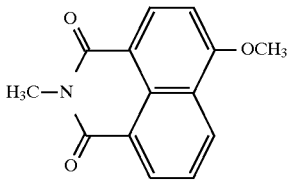

(33)

Preferred triazinyl-pyrenes used are those of formula:

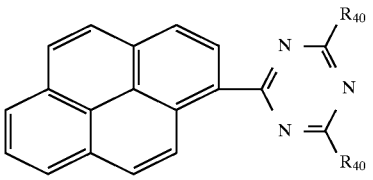

(34)

in which each $R_{40}$, independently, is $C_1$–$C_4$-alkoxy.

Especially preferred compounds of formula (34) are those in which each $R_{40}$ is methyl.

Preferred 2-styryl-benzoxazole- or -naphthoxazole derivatives are those having the formula:

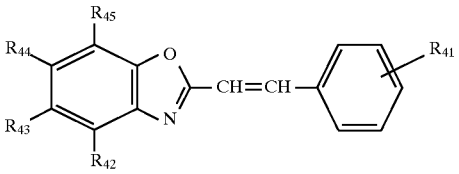

(35)

in which $R_{41}$ is CN, Cl, COO—$C_1$–$C_4$-alkyl or phenyl; $R_{42}$ and $R_{43}$ are the atoms required to form a fused benzene ring or $R_{43}$ and $R_{45}$, independently, are H or $C_1$–$C_4$-alkyl; and $R_{44}$ is H, $C_1$–$C_4$-alkyl or phenyl.

Especially preferred compounds of formula (35) are those in which $R_{41}$ is a 4-phenyl group and each of $R_{42}$ to $R_{45}$ is H.

Preferred benzimidazole-benzofuran derivatives are those having the formula:

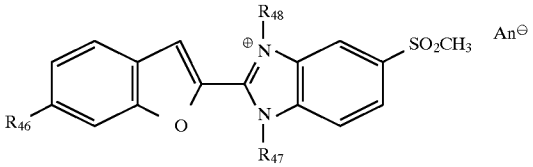

(36)

in which $R_{46}$ is $C_1$–$C_4$-alkoxy; $R_{47}$ and $R_{48}$, independently, are $C_1$–$C_4$-alkyl; and $An^{\ominus}$ has its previous significance.

A particularly preferred compound of formula (36) is that in which $R_{46}$ is methoxy, $R_{47}$ and $R_{48}$ are each methyl and $An^{\ominus}$ is methane sulfonate.

The UVA or FWA compound used in a composition or method of the present invention may be only sparingly soluble in water and may need to be applied in emulsified or dispersed form. For this purpose, it may be milled with an appropriate anionic, nonionic or cationic emulsifying or dispersing agent, or a mixture thereof, conveniently using quartz balls and an impeller, down to a particle size of 1–2 microns.

As emulsifying or dispersing agents for the UVA or FWA compound there may be mentioned:

- acid esters or their salts of alkylene oxide adducts, e.g., acid esters or their salts of a polyadduct of 4 to 40 moles of ethylene oxide with 1 mole of a phenol, or phosphoric acid esters of the adduct of 6 to 30 moles of ethylene oxide with 1 mole of 4nonylphenol, 1 mole of dinonylphenol or, especially, with 1 mole of compounds which have been produced by the addition of 1 to 3 moles of styrenes on to 1 mole of phenol;
- polystyrene sulphonates;
- fatty acid taurides;
- alkylated diphenyloxide-mono- or -di-sulphonates;
- sulphonates of polycarboxylic acid esters;
- addition products of 1 to 60, preferably 2 to 30 moles of ethylene oxide and/or propylene oxide on to fatty amines, fatty amides, fatty acids or fatty alcohols, each having 8 to 22 carbon atoms, or on to tri- to hexavalent $C_3$–$C_6$alkanols, the addition products having been converted into an acid ester with an organic dicarboxylic acid or with an inorganic polybasic acid; lignin sulphonates; and, in particular formaldehyde condensation products, e.g., condensation products of lignin sulphonates and/or phenol and formaldehyde; condensation products of formaldehyde with aromatic sulphonic acids, e.g., condensation products of ditolylethersulphonates and formaldehyde; condensation products of naphthalenesulphonic acid and/or naphthol- or naphthylaminesulphonic acids and formaldehyde; condensation products of phenolsulphonic acids and/or sulphonated dihydroxydiphenylsulphone and phenols or cresols with formaldehyde and/or urea; or condensation products of diphenyloxide-disulphonic acid derivatives with formaldehyde.

In addition to the UVA and/or FWA compound, the composition used according to method of the present invention may also contain a minor proportion of one or more adjuvants. Examples of adjuvants include emulsifiers, perfumes, colouring dyes, opacifiers, bactericides, nonionic surfactants, anti-gelling agents such as nitrites or nitrates of alkali metals, especially sodium nitrate, and corrosion inhibitors such as sodium silicate.

The amount of each of these optional adjuvants should not exceed 1% by weight of the composition.

Depending on the type of UVA and/or FWA compound used, it may be beneficial to carry out the method of treatment according to the invention in a neutral, alkaline or acidic bath. The method is usually conducted in the temperature range of from 20° to 140° C., for example at or near to the boiling point of the aqueous bath, e.g. at about 90° C.

When a method of the present invention employs an FWA compound, the FWA compound may be applied to textile fibre material by means of a laundry treatment, in particular using a detergent or after-rinse composition.

Solutions of the UVA and/or FWA compound, or their emulsions in organic solvents may also be used in the method of the present invention. For example, the so-called solvent dyeing (pad thermofix application) or exhaust dyeing methods in dyeing machines may be used.

If the method of the present invention is combined with a textile treatment or finishing method, such combined treatment may be advantageously carried out using appropriate stable preparations which contain the UVA and/or FWA compound in a concentration such that the desired SPF improvement is achieved.

It is often advantageous to use the UVA and/or FWA compound in admixture with an assistant or extender such as anhydrous sodium sulfate, sodium sulfate decahydrate, sodium chloride, sodium carbonate, an alkali metal phosphate such as sodium or potassium orthophosphate, sodium or potassium pyrophosphate or sodium or potassium tripolyphosphate, or an alkali metal silicate such as sodium silicate.

The methods of the present invention, in addition to providing protection to the skin, and imparting wash permanence to a textile article, also increase the useful life of a textile article treated according to the present invention, for example by preserving its tear strength and/or its lightfastness.

The following Examples further illustrate the present invention.

EXAMPLE 1

An aqueous textile treatment bath is made up having the composition:

2 g/l acetic acid (40%).

20 g/l of a mixture comprising:

a) 50% by weight UVA compound of formula:

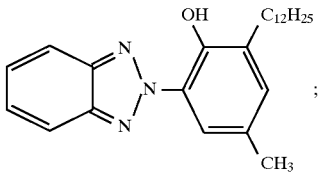

(37)

;

b) 37.5% by weight Lutensol ON 60 (nonionic emulsifier); and c) 12.5% by weight Arlecel C (nonionic emulsifier).

Cotton cretonne is padded (80% pick up) with the above finishing bath, thereby providing 0.8% by weight of the UVA compound of formula (37) on the cotton substrate. The cotton sample is then dried at 80° C. for 2 minutes and cured for 1 minute at 170° C.

The Sun Protection Factor (SPF) is determined by measurement of the UV light transmitted through the swatch, using a double grating spectrophotometer fitted with an Ulbricht bowl. Calculation of SPF is conducted as described by B. L. Diffey and J. Robson in J. Soc. Cosm. Chem. 40 (1989), pp. 130–131.

The whiteness (GW) of the treated goods is measured with a DCI/SF 500 spectrophotometer according to the Ganz method. The Ganz method is described in detail in the Ciba-Geigy Review, 1973/1, and also in the article "Whiteness Measurement", ISCC Conference on Fluorescence and the Colorimetry of Fluorescent Materials, Williamsburg, February 1972, published in the Journal of Color and Appearance, 1, No.5 (1972).

In order to evaluate the wash fastness of the treated cotton samples, respective samples are washed once, five times or ten times, in an aqueous bath containing 7 g/l of a standard ECE detergent having the composition (weight %):

| | |
|---|---|
| 8.0% | Sodium alkylbenzene sulfonate |
| 2.9% | Tallow alcohol-tetradecane-ethylene glycol ether (14 mols EO) |
| 3.5% | Sodium soap |
| 43.8% | Sodium tripolyphosphate |
| 7.5% | Sodium silicate |
| 1.9% | Magnesium silicate |
| 1.2% | Carboxymethyl cellulose |
| 0.2% | EDTA |
| 21.2% | Sodium sulfate |
| | Water to 100%. |

Each wash is conducted at 60° C. for 15 minutes at a liquor ratio of 1:10.

The results obtained are set out in the following Table 1.

TABLE 1

| | Concentration | SPF number of washes | | | | GW number of washes | | | |
|---|---|---|---|---|---|---|---|---|---|
| Example | of UVA | none | one | five | ten | none | one | five | ten |
| — | nil (control) | 4.0 | — | — | — | — | — | — | — |
| 1 | 20 g/l | 29.8 | 33.2 | 24.8 | 25.4 | 59 | 57 | 73 | 73 |

The results in Table 1 show that the cotton sample treated according to the present invention has a substantially increased SPF rating relative to the control sample and that, even after 10 washes, the SPF rating of the washed sample which has been treated according to the present invention is more than six times that of the control sample.

EXAMPLE 2

Using the procedure described in Example 1, the bath used therein is replaced by a bath having the composition:

2 g/l acetic acid (40%)

10 g/l of a mixture comprising:

a) 50% by weight UVA compound of formula (37);

b) 37.5% by weight Lutensol ON 60 (nonionic emulsifier); and c) 12.5% by weight Arlecel C (nonionic emulsifier), thereby providing 0.4% by weight of the UVA compound of formula (2) on the cotton substrate.

The results obtained are set out in the following Table 2.

TABLE 2

| Example | Concentration of UVA | SPF number of washes none | one | five | ten | GW number of washes none | one | five | ten |
|---|---|---|---|---|---|---|---|---|---|
| — | nil (control) | 4.0 | — | — | — | — | — | — | — |
| 2 | 10 g/l | 29.6 | 22.5 | 13.8 | 12.8 | 64 | 53 | 75 | 76 |

The results in Table 2 show that the cotton sample treated according to the present invention has a substantially increased SPF rating relative to the control sample and that, even after 10 washes, the SPF rating of the washed sample which has been treated according to the present invention is more than three times that of the control sample.

EXAMPLE 3

Using the procedure described in Example 1, the bath used therein is replaced by a bath having the composition:

2 g/l acetic acid (40%)

25 g/l of a mixture comprising:

a) 50% by weight UVA compound of formula (37);

b) 37.5% by weight Lutensol ON 60 (nonionic emulsifier); and c) 12.5% by weight Arlecel C (nonionic emulsifier), thereby providing 1.0% by weight of the UVA compound of formula (2) on the cotton substrate.

The results obtained are set out in the following Table 3.

TABLE 3

| Example | Concentration of UVA | SPF number of washes none | one | five | ten | GW number of washes none | one | five | ten |
|---|---|---|---|---|---|---|---|---|---|
| — | nil (control) | 4.0 | — | — | — | — | — | — | — |
| 3 | 25 g/l | 41.3 | 36.1 | 28.8 | 25.3 | 60 | 57 | 71 | 72 |

The results in Table 3 show that the cotton sample treated according to the present invention has a substantially increased SPF rating relative to the control sample and that, even after 10 washes, the SPF rating of the washed sample which has been treated according to the present invention is more than six times that of the control sample.

EXAMPLE 4

An aqueous textile finishing bath is made up having the composition:

20 g/l polydimethylsiloxane emulsion 5 g/l hydrogenpolysiloxane emulsion 3 g/l aqueous silicone catalyst 2 g/l acetic acid (40%) and 20 g/l UVA compound of formula (37).

Dyed 100% cotton poplin (125 g/m$^2$) is padded (73% pick up) with the above finishing bath. The cotton sample is then dried at 110° C. and cured for 4 minutes at 150° C.

In order to evaluate the wash fastness of the treated cotton samples, respective samples are washed once, ten times or thirty times in an aqueous bath containing 7 g/l of a standard ECE detergent having the composition described in Example 1.

Each wash is conducted at 60° C. for 15 minutes at a liquor ratio of 1:10.

The results obtained are set out in the following Table 4.

TABLE 4

| Example | Concentrafion of UVA | SPF number of washes none | five | ten | thirty |
|---|---|---|---|---|---|
| — | nil (control) | 7.6 | 6.7 | 7.6 | 7.6 |
| 4 | 20 g/l | 18.0 | 13.2 | 13.1 | 12.3 |

The results in Table 4 show that the cotton sample treated according to the present invention has a substantially increased SPF rating relative to the control sample and that, even after 30 washes, the SPF rating of the washed sample which has been treated according to the present invention is almost double that of the control sample.

Each of the cotton sample treated according to Example 4 and the control cotton sample is exposed to irradiation with a Xenon lamp for 160 hours. The blue scale whiteness, the colour difference (ΔE) and the tear resistance of the respective samples are then determined.

The blue scale whiteness and the colour difference (ΔE) values of the cotton sample treated according to Example 4 are slightly better than those of the control sample. The tear value of the cotton sample treated according to Example 4 is virtually the same as that of the control sample.

Similar results are obtained when there is used in the aqueous textile finishing bath, instead of 20 g/l of the UVA of formula (37), 10 g/l, 40 g/l, 60 g/l, 80 g/l or 100 g/l of the UVA of formula (37), respectively.

EXAMPLE 5

Using the procedure described in Example 4, similar results are obtained when the bath used therein is replaced by a bath having the composition:

40 g/l polydimethylsiloxane emulsion 10 g/l polydimethylsiloxane emulsion 6 g/l aqueous silicone catalyst 2 g/l acetic acid (40%) and 20 g/l UVA compound of formula (37).

EXAMPLE 6

Using the procedure described in Example 4, similar results are obtained when the bath used therein is replaced by a bath having the composition:

60 g/l polydimethylsiloxane emulsion 15 g/l hydrogenpolysiloxane emulsion 10 g/l aqueous silicone catalyst 2 g/l acetic acid (40%) and 20 gl UVA compound of formula (37).

EXAMPLE 7

An aqueous textile finishing bath is made up having the composition:

20 g/l polydimethylsiloxane emulsion 5 g/l hydrogenpolysiloxane emulsion 3 g/l aqueous silicone catalyst 2 g/l acetic acid (40%) and 40 g/l UVA compound of formula (37).

Using the procedure described in Example 4, but replacing the dyed cotton poplin substrate with a cotton substrate (106 g/m$^2$) having a porosity of 1.3%, the results set out in the following Table 5 are obtained.

TABLE 5

| Example | Test UVA | SPF number of washes none | five | ten | thirty |
|---|---|---|---|---|---|
| — | nil (control) | 4.3 | 5.2 | 3.8 | 3.9 |
| 7 | compound (37) | 57.8 | 48.6 | 40.2 | 30.6 |

Similar results are obtained when the bath used in Example 7 is modified by the omission of the acetic acid component.

EXAMPLE 8

An aqueous textile finishing bath is made up having the composition:

20 g/l polydimethylsiloxane emulsion 5 g/l hydrogenpolysiloxane emulsion 3 g/l aqueous silicone catalyst 2 g/l acetic acid (40%)

20 g/l hydrophilic silicone elastomer and 40 g/l UVA compound of formula (37).

Using the procedure described in Example 4, the results set out in the following Table 6 are obtained.

TABLE 6

| Example | Test UVA | SPF number of washes none | five | ten | thirty |
|---|---|---|---|---|---|
| — | nil (control) | 4.3 | 5.2 | 3.8 | 3.9 |
| 8 | Compound (37) | 69.6 | 40.4 | 33.6 | 43.6 |

EXAMPLES 9 TO 11

An aqueous textile treatment bath is made up as in Example 1 having the composition:

2 g/l acetic acid (40%); and 125 g/l of compound (37) as a 5% emulsion.

Similar aqueous emulsions or dispersions are made up by replacing the compound of formula (37) by a compound having the formula (38):

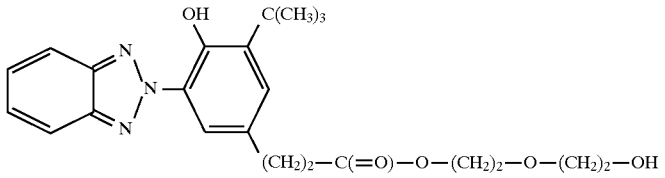

(38)

applied as a 5% by weight aqueous emulsion; or (39):

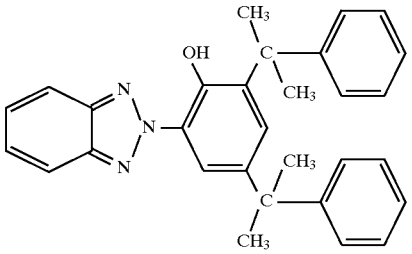

(39)

applied as a 5% dispersion by milling 5% of the compound and 1% of a nonionic dispersing agent which is a polypropylene glycol containing 82% ethylene oxide, in the presence of glass beads in deionised water.

Cotton cretonne (140 g/m$^2$) is padded (80% pick up) with the above finishing bath. The cotton sample is then dried at 80° C. for 2 minutes and cured for 1 minute at 170° C.

In order to evaluate the wash fastness of the treated cotton samples, respective samples are washed once, ten times or thirty times in an aqueous bath containing 7 g/l of a standard ECE detergent having the composition described in Example 1.

Each wash is conducted at 60° C. for 15 minutes at a liquor ratio of 1:10.

The results obtained are set out in the following Table 7.

TABLE 7

| Example | Test UVA | SPF number of washes none | one | five | ten |
|---|---|---|---|---|---|
| — | nil (control) | 8 | 5 | 7 | 6 |
| 9 | Compound (37) | 43 | 32 | 32 | 27 |
| 10 | Compound (38) | 40 | 22 | 16 | 14 |
| 11 | Compound (39) | 39 | 29 | 15 | 17 |

EXAMPLE 12

An aqueous textile finishing bath is made up having the composition:

70 g/l urea crosslinking agent 21 g/l $MgCl_2$ 0.2 g/l Na-fluoroborate 30 g/l methylolated formaldehyde plasticiser and 30 g/l polyethylene wax finish.

To separate samples of this bath are added either 5 g/l or 10 g/l of the UVA compound of formula (37).

As the above UVA compound is insoluble in water, it is added as a 5% (w/w) aqueous emulsion which is obtained by milling 5% of the UVA compound and 1% of an emulsifier consisting of a polypropylene glycol containing 80% ethylene oxide, in the presence of glass beads in deionised water.

Separate samples of 100% cotton poplin are foularded (84% liquor uptake) with separate samples of the above finishing baths. The cotton samples are then dried for 3 minutes at 110° C. and cured for 5 minutes at 150° C.

The cotton poplin samples used each have a porosity of 0.6%, a thickness of 0.18 mm and a density of 0.67 g/cm$^3$. The porosity is determined by measurement of the directed transmission using a Perkin Elmer Lamda 9.

In order to evaluate the wash fastness of the treated cotton samples, respective samples are washed once, five times or ten times in an aqueous bath containing 7 g/l of a standard ECE detergent having the composition defined in Example 1.

Each wash is conducted at 60° C. for 15 minutes at a liquor ratio of 1:10.

The results obtained are set out in the following Table 8.

TABLE 8

| Example | Concentrafion of UVA | SPF number of washes none | one | five | ten |
|---|---|---|---|---|---|
| — | nil (control) | 3.4 | 3.3 | 3.2 | 3.3 |
| 12 | 5 g/l | 11.7 | 11.7 | 8.0 | 6.6 |
| | 10 g/l | 17.7 | 23.6 | 14.0 | 10.0 |

The results in Table 8 show that the cotton samples treated according to the present invention have a substantially increased SPF rating relative to the control samples and that, even after 10 washes, the SPF rating of the washed samples which have been treated according to the present invention is at least double that of the control samples.

EXAMPLES 13 TO 16

An aqueous textile finishing bath is made up as described in Example 12.

To separate samples of this bath there are added 20, 40, 60 or 80 g/l of an emulsion of the compound (37), as described in Example 12.

Separate samples of 100% cotton voile are foularded (84% liquor uptake) with separate samples of the above finishing baths. The cotton samples are then dried for 3 minutes at 110° C. and cured for 5 minutes at 145° C.

The cotton voile samples used each had a porosity of 24%, a thickness of 0.20 mm and a density of 0.55 g/cm$^3$.

The SPF values of the respective treated samples are determined as described in Example 12 and the results obtained are set out in the following Table 9.

TABLE 9

| Example | Concentration of UVA | SPF |
|---|---|---|
| — | nil (control) | 1.7 |
| 13 | 20 g/l | 3.8 |
| 14 | 40 g/l | 3.6 |
| 15 | 60 g/l | 4.0 |
| 16 | 80 g/l | 4.1 |

EXAMPLES 17 TO 20

The procedure described in Examples 13 to 16 is repeated except that the cotton voile samples used therein are replaced by cotton poplin having a porosity of 0.4%, a thickness of 0.19 mm and a density of 0.57 g/cm$^3$.

The SPF values of the respective treated samples are determined as described in Example 12 and the results obtained are set out in the following Table 10.

TABLE 10

| Example | Concentration of UVA | SPF |
|---|---|---|
| — | nil (control) | 3 |
| 17 | 20 g/l | 46 |
| 18 | 40 g/l | 83 |
| 19 | 60 g/l | 105 |
| 20 | 80 g/l | 103 |

EXAMPLE 21

An aqueous textile finishing bath is made up having the following composition.

2 g/l 40% acetic acid 50 g/l weakly cationic emulsion of an extender-containing fluorine compound and 12.5 g/l compound (37) as a 50% aqueous emulsion The procedure described in Examples 13 to 16 is repeated except that the cotton voile samples used therein are replaced by an awning cotton material having a porosity of 0.04%, a thickness of 0.52 mm and a density of 0.69 g/cm$^3$.

The SPF values of the respective treated samples are determined as described in Example 12 and the results obtained are set out in the following Table 11.

TABLE 11

| Example | Concentration of UVA | SPF |
|---|---|---|
| — | nil (control) | 19.6 |
| 21 | 12.5 g/l | >>100 |

EXAMPLES 22 TO 27

An aqueous textile finishing bath is made up having the following composition.

2 g/l 40% acetic acid 60 g/l polydimethylsiloxane emulsion 15 g/l hydrogenpolysiloxane emulsion 10 g/l aqueous silicone catalyst and 10, 20, 40, 60, 80 or 100 g/l compound (37) as a 50% aqueous emulsion.

The procedure described in Examples 13 to 16 is repeated except that the cotton voile samples used therein are replaced by a a light blue-dyed cotton material having a porosity of 3.3%, a thickness of 0.28 mm and a density of 0.51 g/cm$^3$.

The SPF values of the respective treated samples are determined as described in Example 12 and the results obtained are set out in the following Table 12.

TABLE 12

| Example | Concentration of UVA | SPF |
|---|---|---|
| — | nil (control) | 6.9 |
| 22 | 10 g/l | 12.4 |
| 23 | 20 g/l | 13.9 |
| 24 | 40 g/l | 19.7 |
| 25 | 60 g/l | 23.8 |
| 26 | 80 g/l | 20.8 |
| 27 | 100 g/l | 19.4 |

EXAMPLES 28 TO 30

An aqueous textile finishing bath is made up having the following composition.

2 g/l 40% acetic acid 40 g/l alkyl-modified dihydoxyethyleneurea/melamine formaldeyde derivative 12 g/l $MgCl_2$ 30 g/l emulsion of fatty acid amides and 10, 20 or 30 g/l compound (37) as a 50% aqueous emulsion.

The procedure described in Examples 13 to 16 is repeated except that the cotton voile samples used therein are replaced by a a cotton material having a porosity of 2.20%, a thickness of 0.20 mm and a density of 0.68 g/cm$^3$.

The SPF values of the respective treated samples are determined as described in Example 12 and the results are set out in the following Table 13.

TABLE 13

| Example | Concentration of UVA | SPF |
|---|---|---|
| — | nil (control) | 1.9 |
| 28 | 10 g/l | 11.2 |
| 29 | 20 g/l | 17.3 |
| 30 | 30 g/l | 17.4 |

EXAMPLES 31 TO 34

The procedure described in Examples 28 to 30 is repeated except that the cotton material used therein is replaced by a cotton fabric having a porosity of 1.30%, a thickness of 0.17 mm and a density of 0.62 g/cm$^3$ and a further test is carried out using 40 g/l of the compound (37).

The SPF values of the respective treated samples are determined as described in Example 12 and the results obtained are set out in the following Table 14.

TABLE 14

| Example | Concentration of UVA | SPF |
|---|---|---|
| — | nil (control) | 4 |
| 31 | 10 g/l | 25 |
| 32 | 20 g/l | 47 |
| 33 | 30 g/l | 81 |
| 34 | 40 g/l | 99 |

EXAMPLES 35 TO 37

The procedures described in Examples 28 to 30 is repeated except that the cotton material used therein is replaced by a cotton fabric having a porosity of 1.90%, a thickness of 0.26 mm and a density of 0.54 g/cm$^3$ and the tests are carried out using slightly different amounts of the compound (37).

The SPF values of the respective treated samples are determined as described in Example 12 and the results obtained are set out in the following Table 15.

TABLE 15

| Example | Concentration of UVA | SPF |
|---|---|---|
| — | nil (control) | 4.1 |
| 35 | 10 g/l | 25 |
| 36 | 20 g/l | 31.3 |
| 37 | 25 g/l | 36.5 |

EXAMPLE 38

An aqueous textile finishing bath is made up having the following composition.

2 g/l 40% acetic acid 40 g/l compound (37) as a 50% aqueous emulsion.

The procedure described in Examples 13 to 16 is repeated except that the cotton voile samples used therein are replaced by a knitted cotton material having a porosity of 0.30%, density of 0.28 g/cm$^3$.

The SPF values of the respective treated samples are determined as described in Example 12 and the results obtained are set out in the following Table 16.

TABLE 16

| Example | Concentration of UVA | SPF |
|---|---|---|
| — | nil (control) | 28 |
| 38 | 40 g/l | >100 |

EXAMPLE 39

The procedure described in Example 38 is repeated except that the knitted cotton material having a porosity of 0.30%, a thickness of 0.82 mm and a density of 0.28 g/cm$^3$, is replaced by a knitted cotton material having a porosity of 0.80%, a thickness of 0.46 mm and a density of 0.32 g/cm$^3$.

The SPF values of the respective treated samples are determined as described in Example 12 and the results obtained are set out in the following Table 17.

TABLE 17

| Example | Concentration of UVA | SPF |
|---|---|---|
| — | nil (control) | 5.7 |
| 39 | 40 g/l | 90 |

TABLE 18

| Example | Concentration of UVA | SPF |
|---|---|---|
| — | nil (control) | 9.6 |
| 40 | 40 g/l | >100 |

EXAMPLE 40

The procedure described in Example 38 is repeated except that the knitted cotton material having a porosity of 0.30%, a thickness of 0.82 mm and a density of 0.28 g/m$^3$, is replaced by a knitted cotton material having a porosity of 0.20%, a thickness of 0.46 mm and a density of 0.32 g/cm$^3$.

The SPF values of the respective treated samples are determined as described in Example 12 and the results obtained are set out in the following Table 18.

The results in Tables 8 to 18 show that the cotton samples treated according to the present invention have a substantially increased SPF rating relative to the control sample.

Similar results are obtained when, in Examples 12 to 40, the compound (37) is replaced by compound (38) or (39) or by one of the following compounds:

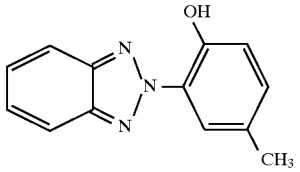

(40)

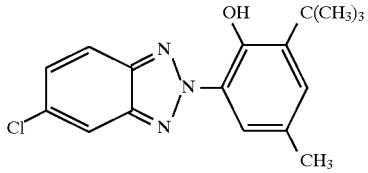

(41)

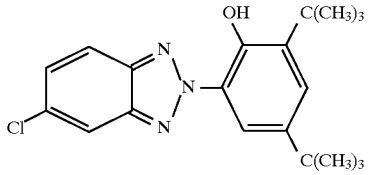

(42)

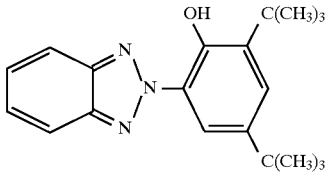

(43)

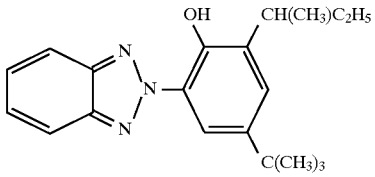

(44)

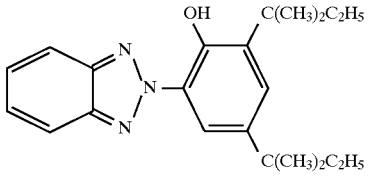

(45)

-continued
(46)
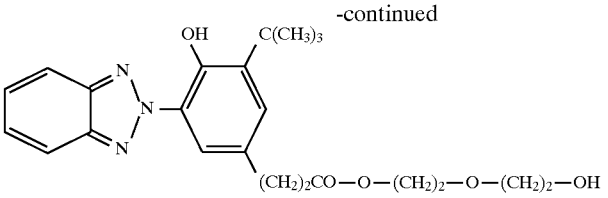
(47)
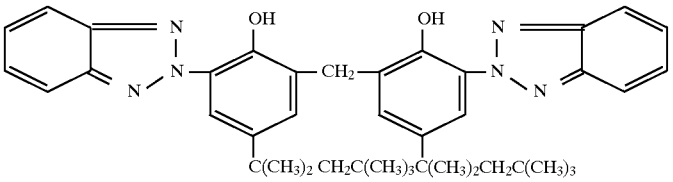
(48)
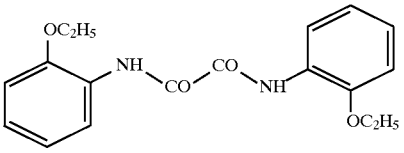
(49)
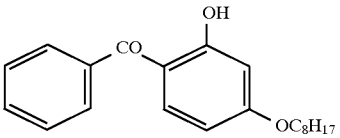
(50)
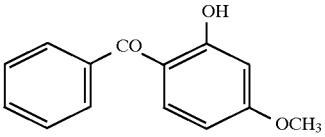
EXAMPLE 41
An aqueous dye bath is made up having the composition:
0.07% of the reactive yellow dye having the formula:
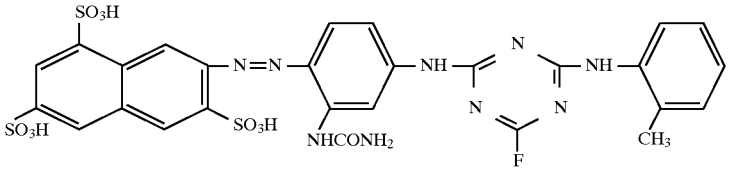
0.07% of the reactive orange dye having the formula:
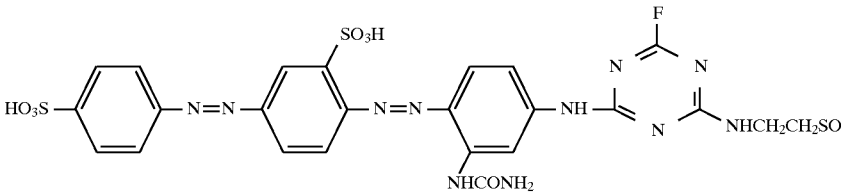
0.07% of dye C.I.Reactive Blue 182
0.25% of the reactive scarlet dye having the formula:

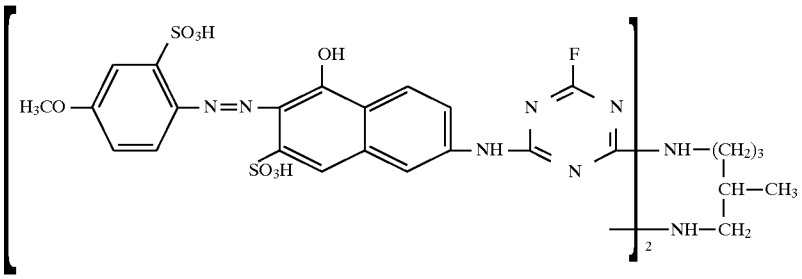

0.60% of dye C.I.Reactive Blue 21

2.00% of an auxiliary consisting of 46.6% of a condensation product of polyethyleneamine, dicyandiamide and zinc chloride, 7.9% sodium gluconate, 1% monoethanolamine, 1% anhydrous acetic acid and 43.5% water 0.50 ml/l of acetic acid and 0.25% of compound of formula (37).

Similar dye baths are made up containing, respectively, 1.00 or 2.00% of the compound of formula (37), instead of 0.25% of compound of formula (37).

Separate samples of bleached, knitted cotton fabric, having a porosity of 0.21%, a thickness of 0.52 mm and a density of 0.32 g/cm$^3$, are dyed in the dye bath (liquor ratio 1:25), by the exhaust method, for 5 minutes at 20° C. The temperature of the dye bath is raised to 40° C. over a further 10 minutes and the cotton samples are then after-treated in the bath for a further 30 minutes. The dyed samples are then rinsed cold.

The SPF values of the after-treated cotton samples are determined in the manner described in Example 1 and the wash fastness values of the cotton samples after-treated with 2.0% of the compound of formula (37) are determined in the manner described in Example 1.

Each wash is conducted at 60° C. for 15 minutes at a liquor ratio of 1:10.

The results obtained are set out in the following Table 19.

TABLE 19

| Example | Concentration of UVA | SPF number of washes none | one | five |
|---|---|---|---|---|
| — | — | 32 | 33 | 35 |
| 41 | 0.25% | 76 | — | — |
| | 1.00% | 124 | — | — |
| | 2.00% | 374 | 273 | 221 |

Similar results are obtained when the procedure described in Example 41 is repeated except that the dye bath auxiliary used consists of 37.5% of a 40% aqueous solution by weight of polydimethyldiallylammonium chloride, 0.2% by weight of chloracetamide and 62.3% of water.

EXAMPLE 42

An aqueous dye bath is made up having the composition:

0.07% of the dye C.I.Direct Yellow 106

0.07% of the dye C.I.Direct Red 89

0.07% of dye C.I.Direct Blue 85

0.25% of dye C.I.Direct Red 9

0.60% of dye C.I.Direct Yellow 96

2.00% of an auxiliary consisting of 46.6% of a condensation product of polyethyleneamine, dicyandiamide and zinc chloride, 7.9% sodium gluconate, 1% monoethanolamine, 1% anhydrous acetic acid and 43.5% water 0.50 ml/l of acetic acid and 0.10% of compound of formula (37).

Similar dye baths are made up containing, respectively, 0.25, 0.50, 1.00 or 2.00% of compound of formula (37), instead of 0.10% of compound of formula (37).

Separate samples of bleached, knitted cotton fabric used in Example 41 are dyed in the dye bath (liquor ratio 1:25), by the exhaust method, for 5 minutes at 20° C. The temperature of the dye bath is raised to 40° C. over a further 10 minutes and the cotton samples are then after-treated in the bath for a further 30 minutes. The dyed samples are then rinsed cold and neutralised with sodium hydroxide.

The SPF values of the after-treated cotton samples are determined in the manner described in Example 1.

The results obtained are set out in the following Table 20.

TABLE 20

| Example | Concentration of UVA | SPF |
|---|---|---|
| — | | 11 |
| 42 | 0.1% | 31 |
| | 0.25% | 48 |
| | 0.50% | 75 |
| | 1.0% | 91 |
| | 2.0% | 238 |

Similar results are obtained when the auxiliary used is replaced by a polyquaternary ammonium compound auxiliary produced by polymerising the hydrohalide salt of a diallylamine.

EXAMPLE 43

A dye bath is prepared by dissolving, at 30° C., 0.25 g/l of an aqueous emulsion of silicone oils and paraffin oil, 0.5 g/l of an aqueous emulsion of polymaleic acid, 1 g/l of an 85:15 acrylamide/acrylic acid copolymer auxiliary, 2 g/l of salt and the same dyes used in Example 41, in the same proportions used in Example 41 and 0.25% by weight of the compound of formula (37). Separate samples of bleached, knitted cotton fabric used in Example 41 are placed in the bath and dyeing is conducted, using the exhaust method (liquor ratio 1:25), by heating the bath to 90° C. over 45 minutes, at which point a further 8 g/l of salt are added. Dyeing is continued at 95° C. for a further 50 minutes, after which the bath temperature is reduced to 75° C. over 20 minutes.

Similar dyeings are conducted using a bath containing, instead of 0.25% of compound (37), 1.00 or 2.00% of compound (37).

The SPF value of the dyed goods and the wash permanence thereof are determined as described in Example 41.

The results obtained are set out in the following Table 21.

TABLE 21

| Example | Concentration of UVA | SPF number of washes none | one | five |
|---|---|---|---|---|
| — | — | 39 | 47 | 44 |
| 43 | 0.25% | 49 | — | — |
| | 1.00% | 73 | — | — |
| | 2.00% | 95 | 88 | 37 |

We claim:

1. An aqueous textile treatment composition comprising:

a) 0.5 to 4% by weight, based on the total weight of the composition, of a non-reactive UVA compound selected from the group consisting of:

i) triazine compounds having the formula:

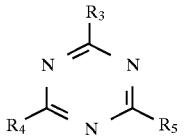

(2)

in which at least one of $R_3$, $R_4$ and $R_5$ is a radical of formula:

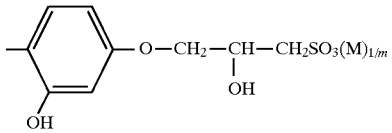

(3)

in which M is hydrogen, sodium, potassium, calcium, magnesium, ammonium, mono-, di-, tri- or tetra-$C_1$–$C_4$alkylammonium, mono-, di- or tri-$C_1$–$C_4$-hydroxyalkylammonium, or ammonium that is di- or tri-substituted by a mixture of $C_1$–$C_4$alkyl and $C_1$–$C_4$hydroxyalkyl groups; m is 1 or 2; and the remaining substituent(s) $R_3$, $R_4$ and $R_5$ are, independently, amino, $C_1$–$C_{12}$alkyl, $C_1$–$C_{12}$alkoxy, $C_1$–$C_{12}$alkylthio, mono- or di-$C_1$–$C_{12}$alkylamino, phenyl, phenylthio, anilino or N-phenyl-N-$C_1$–$C_4$alkylamino, the respective phenyl substituents being optionally substituted by $C_1$–$C_{12}$alkyl or -alkoxy, $C_5$–$C_8$cycloalkyl or halogen;

ii) triazine compounds having the formula:

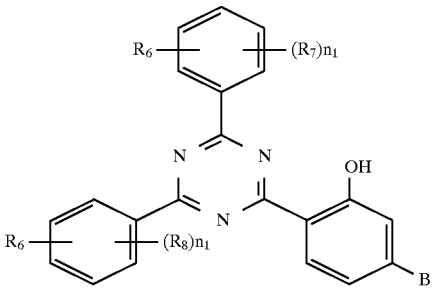

(4)

in which $R_6$ is hydrogen or hydroxy; $R_7$ and $R_8$, independently, are hydrogen or $C_1$–$C_4$alkyl; $n_1$ is 1 or 2; and B is a group of formula:

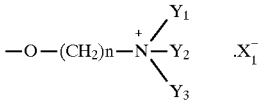

in which n is an integer ranging from 2 to 6; $Y_1$ and $Y_2$, independently, are $C_1$–$C_4$alkyl optionally substituted by halogen, cyano, hydroxy or $C_1$–$C_4$alkoxy, or $Y_1$ and $Y_2$, together with the nitrogen atom to which they are each attached, form a 5–7 membered heterocyclic ring; $Y_3$ is hydrogen, $C_3$–$C_4$alkenyl or $C_1$–$C_4$alkyl optionally substituted by cyano, hydroxy or $C_1$–$C_4$alkoxy, or $Y_1$, $Y_2$ and $Y_3$, together with the nitrogen atom to which they are each attached, form a pyridine or picoline ring; and $X_1^-$ is a colourless anion;

iii) triazole compounds having the formula:

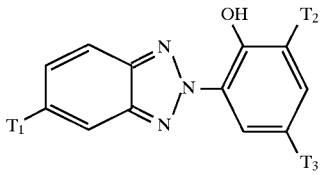

(5)

in which $T_1$ is chlorine or hydrogen; $T_2$ is hydrogen or a $C_4$–$C_{30}$alkyl group; and $T_3$ is a $C_1$–$C_5$alkyl group, optionally substituted by a phenyl group or optionally substituted by a group —CO—O—$C_1$–$C_{18}$alkyl which is optionally substituted by a hydroxy group and is optionally interrupted by one or two oxygen atoms;

iv) triazole compounds having the formula:

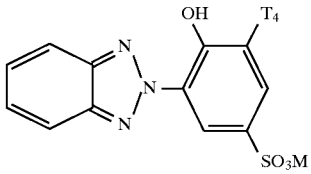

(6)

in which $T_4$ is hydrogen, $C_1$–$_{12}$alkyl or benzyl; and M is hydrogen, sodium, potassium, calcium, magnesium, ammonium, mono-, di-, tri- or tetra-$C_1$–$C_4$alkylammonium, mono-, di- or tri-$C_1$–$C_4$-hydroxy-alkylammonium, or ammonium that is di- or tri-substituted by a mixture of $C_1$–$C_4$alkyl and $C_1$–$C_4$-hydroxyalkyl groups; and v) triazole compounds having the formula:

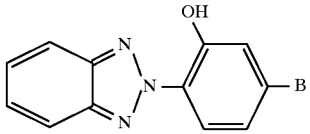

(7)

in which B is a group of the formula:

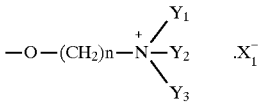

in which n is an integer ranging from 2 to 6; $Y_1$ and $Y_2$, independently, are $C_1$–$C_4$alkyl optionally substituted by halogen, cyano, hydroxy or $C_1$–$_4$alkoxy, or $Y_1$ and $Y_2$, together with the nitrogen atom to which they are each attached, form a 5–7 membered heterocyclic ring; $Y_3$ is hydrogen, $C_3$–$C_4$alkenyl or $C_1$–$C_4$alkyl optionally substituted by cyano, hydroxy or $C_1$–$C_4$alkoxy, or $Y_1$, $Y_2$ and $Y_3$, together with the nitrogen atom to which they are each attached, form a pyridine or picoline ring; and b) 0.5 to 4% by weight, based on the total weight of the composition, of an emulsifying or dispersing agent for the UVA compound;

c) water; and, d) 0.5 to 20% by weight based on the total weight of the composition of a polysiloxane-based finishing product for textile fibre material.

2. A composition according to claim 1 in which the triazole UVA compound has the formula:

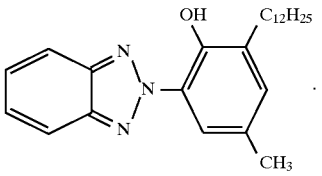

3. A composition according to claim 1 in which the triazine UVA compound has the formula:

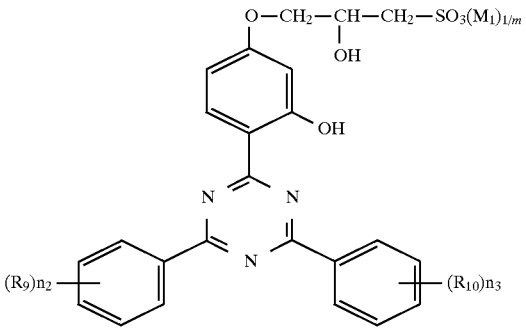

in which $R_9$ and $R_{10}$, independently, are $C_1$–$C_{12}$alkyl; m is 1 or 2; $M_1$ is hydrogen, sodium, potassium, calcium, magnesium, ammonium or tetra-$C_1$–$C_{12}$alkylammonium; and $n_2$ and $n_3$, independently, are 0, 1 or 2.

4. A composition according to claim 1 in which $R_9$ and $R_{10}$, independently, are methyl;

m is 1 or 2; $M_1$ is hydrogen; and $n_2$ and $n_3$, independently, are 1 or 2.

5. A composition according to claim 1 in which the triazine UVA compound is:

2,4-diphenyl-6-[2-hydroxy-4-(2-hydroxy-3-sulfopropoxy)-phenyl]-1,3,5-triazine;

2-phenyl-4,6-bis-[2-hydroxy4-(2-hydroxy-3-sulfopropoxy)-phenyl]-1,3,5-triazine;

2,4-bis(2,4-dimethylphenyl)-6-[2-hydroxy-4-(2-hydroxy-3-sulfopropoxy)-phenyl]-1,3,5-triazine; or 2,4-bis(4-methylphenyl)-6-[2-hydroxy-4-(2-hydroxy-3-sulfo propoxy)-phenyl]-1,3,5-triazine.

6. A composition according to claim 1 in which the emulsifying or dispersing agent, component b), is an anionic, nonionic or cationic emulsifying or dispersing agent, or a mixture thereof.

7. A composition according to claim 6 in which the emulsifying or dispersing agent is selected from the group consisting of:

acid esters or their salts of alkylene oxide adducts;

polystyrene sulphonates;

fatty acid taurides;

alkylated diphenyloxide-mono- or -di-sulphonates;

sulphonates of polycarboxylic acid esters;

addition products of 1 to 60 moles of ethylene oxide and/or propylene oxide on to fatty amines, fatty amides, fatty acids or fatty alcohols, each having 8 to 22 carbon atoms, or on to tri- to hexavalent $C_3$–$C_6$alkanols, the addition products having been converted into an acid ester with an organic dicarboxylic acid or with an inorganic polybasic acid;

lignin sulphonates; and formaldehyde condensation products.

8. A composition according to claim 1 in which the polysiloxane-based product, component d), is present and is any commercially available polysiloxane-based product which is conventionally used for the finishing of a textile fibre material.

9. A composition according to claim 8 in which the polysiloxane-based product is an elastomer, hydrophobising agent, film- or non film-forming product or fabric softener.

10. A composition according to claim 8 in which the polysiloxane-based product is a dialkylpolysiloxane, optionally containing epoxy, hydroxy, polyethoxy, polypropoxy or polyethoxy/polypropoxy groups.

11. A composition according to claim 10 in which the polysiloxane-based product is formulated as an aqueous emulsion using, as emulsifying agent, one or more anionic, nonionic or cationic emulsifiers.

12. A composition according to claim 11 in which the pH of the emulsion is adjusted to a value of 5–6.

13. A composition according to claim 1 which also contains one or more auxiliaries which are conventionally present in textile treatment compositions.

14. A composition according to claim 13 in which the auxiliaries are selected from one or more of fluorescent whitening agents, crease-resist agents, fabric softeners, stiffening agents and anti-static agents.

15. A composition according to claim 14 in which the fluorescent whitening agents are selected from 4,4'-bis-(triazinylamino)-stilbene-2,2'-disulfonic acids, 4,4'-bis-(triazol-2-yl)stilbene-2,2'-disulfonic acids, 4,4'-(diphenyl)-stilbenes, 4,4'-distyryl-biphenyls, 4phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarines, pyrazolines, naphthalimides, triazinyl-pyrenes, 2-styryl-benzoxazole- or -naphthoxazole derivatives or benzimidazole-benzofuran derivatives.

16. A composition according to claim 1 in which component d) is present in a proportion within the range of from 1 to 10% by weight, based on the total weight of the composition.

17. A composition according to claim 16 in which each of components a) and b) is present in a proportion within the range of from 2 to 4% by weight, based on the total weight of the composition.

18. A composition according to claim 14 in which one or more auxiliaries are present, each in a proportion within the range of from 0.05 to 5% by weight, based on the total weight of the composition.

* * * * *